United States Patent [19]

Lack

[11] 4,426,895

[45] Jan. 24, 1984

[54] RATCHET WRENCH

[76] Inventor: Larry H. Lack, 901 Lincoln Dr., Shreveport, La. 71107

[21] Appl. No.: 352,182

[22] Filed: Feb. 25, 1982

[51] Int. Cl.[3] ..... B25B 17/00

[52] U.S. Cl. ..... 81/57.39; 81/57.31

[58] Field of Search ..... 81/57.39, 57.31

[56] References Cited

U.S. PATENT DOCUMENTS

| | | | |
|---|---|---|---|
| 2,520,443 | 8/1950 | Seaquist | 81/57.31 |
| 2,641,136 | 6/1953 | Marsden et al. | 81/57.31 |
| 3,828,629 | 8/1974 | Moore | 81/57.39 |

*Primary Examiner*—James L. Jones, Jr.

[57] ABSTRACT

A ratchet wrench having a top housing and a first handle cooperating with the top housing; a bottom housing with a cooperating second handle; a ratchet drum disposed within the top housing and the bottom housing and provided with exterior splines and a pair of side bevel gears rotatably mounted on a horizontal shaft in opposed relationship inside the ratchet drum; a top bevel gear attached to the inside of the top housing and extending inside the ratchet drum to engage the side bevel gears; a drive bevel gear engaging the side bevel gears and rotatably positioned on the bottom housing interior, and carrying a socket drive extending from the bottom housing; top and bottom ratchet means mounted on the first and second handles, respectively, and selectively cooperating with the ratchet drum; and a handle lock means for selectively allowing the first and second handles to be manipulated as one handle, or separately to operate the ratchet wrench in a more efficient manner.

10 Claims, 8 Drawing Figures

FIG. 5
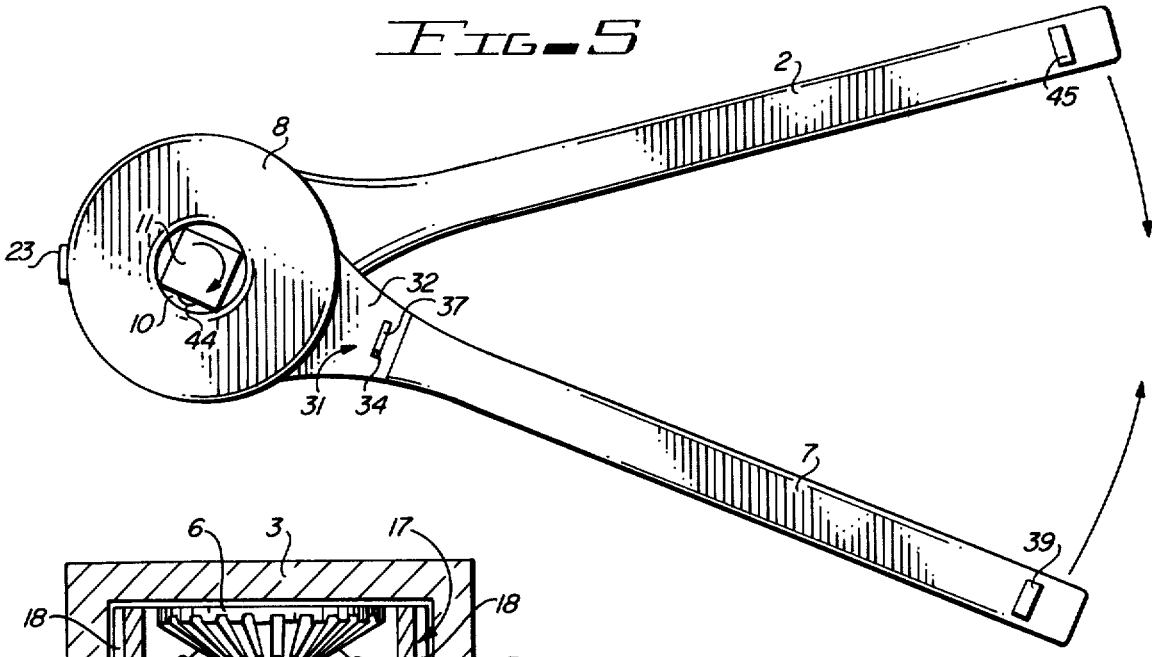
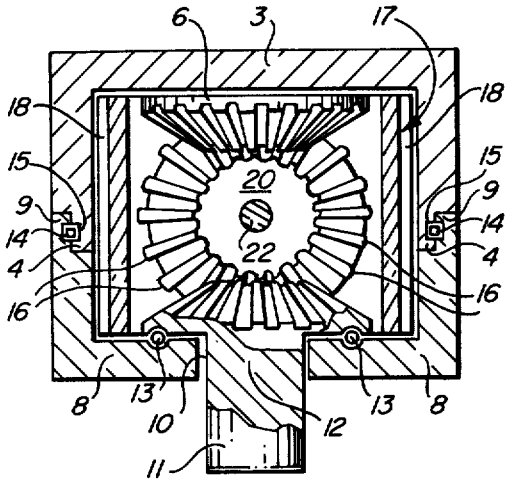
FIG. 6
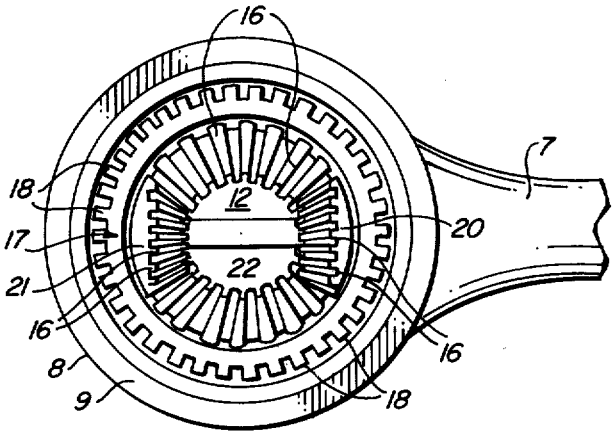
FIG. 8
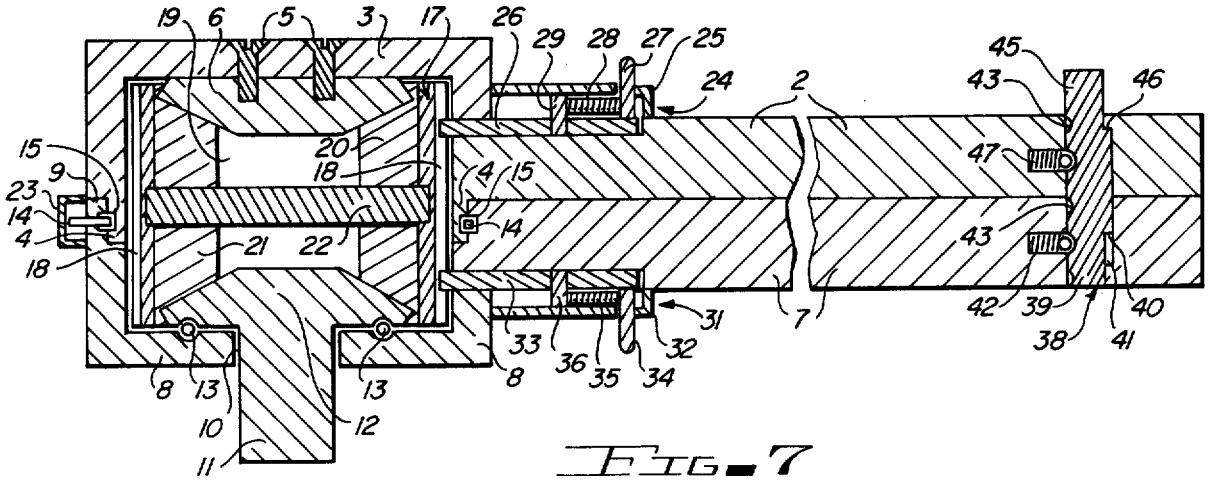
FIG. 7

RATCHET WRENCH

BACKGROUND OF THE INVENTION

1. Field of the Invention

This invention relates to ratchet drive devices, and more particularly, to a ratchet wrench which is characterized by top and bottom handles fixedly attached to, or shaped integrally with separate housing elements to achieve a mechanical advantage in driving a socket drive extending from the bottom housing element. The split housing encloses a cylindrically shaped, hollow ratchet drum having vertically oriented, external splines and rotatably situated in the housing. The ratchet drum contains a pair of oppositely-disposed side bevel gears rotatably mounted on a horizontal shaft fixedly mounted inside the ratchet drum, and a top bevel gear is attached to the inside of the top housing element, and extends inside the ratchet drum to engage the side bevel gears on the shaft. Similarly, a drive bevel gear rotatably engages the side bevel gears at a point on the lower housing element opposite the top bevel gear, and carries a socket drive which extends from the drive bevel gear through the lower housing element to receive a socket. The respective handles and housing elements are rotatable with respect to the ratchet drum, and are designed to drive the ratchet drum and the socket drive in a desired direction by means of a top and bottom ratchet, attached to the top and bottom handles, respectively, depending upon the relative position of ratchet pawls in engagement with the ratchet drum splines. For example, adjustment of the ratchet pawls for engagement in a common first position in the top and bottom ratchet, respectively, facilitates rapid rotation of the socket drive in a clockwise direction when the top and bottom handles are alternately rotated in opposite directions. Conversely, when the ratchet pawls are moved into a common second position in the top and bottom ratchet, rotation of the handles in opposite directions facilitates movement of the socket drive in the counter-clockwise direction. Furthermore, with the ratchet pawls adjusted in a first common engaged position in the top and bottom ratchets, respectively, and the top and bottom handles held or locked together in parallel fashion, the ratchet wrench can be used as a conventional ratchet wrench, and movement of the top and bottom handles in concert against the locked ratchet pawls drives the socket drive in a selected direction. Conversely, adjustment of the ratchet pawls in a second common direction and maintaining the top and bottom handles in alignment while rotating the handles in the opposite direction effects a rotation of the socket drive in that opposite direction. In a preferred embodiment of the invention the top and bottom handle can be secured to act in concert or released for manipulation in different directions by means of a handle lock which cooperates with the top and bottom handles.

2. Description of the Prior Art

Devices for driving bolts, lag screws and other fastening devices having heads suited for manipulation by sockets are well known in the prior art. Such devices include single and double-head wrenches, box and open end wrenches and similar tools. More sophisticated wrenches having a ratcheting function were developed to solve the problem of installing bolts and nuts and other fasteners having a square or hexagonal head configuration in cramped locations, such as in or near engines and machinery, where a conventional wrench cannot be engaged and operated in a complete circle or in a substantial arc without contacting other parts of the machine. In such application, conventional wrenches must be first engaged with the nut or bolt head, rotated to the extent possible to tighten or loosen the nut or bolt, and repositioned for another sequence. The conventional ratchet wrench allows the user to adjust the ratchet pawl in the drive drum splines to achieve clockwise or counter-clockwise driving of the socket drive and return of the wrench handle to the initial placement position by operation of the ratchet. Such ratchet drive devices are available in a variety of sizes, and are highly useful in tightening and loosening nuts and bolts.

An improved ratchet wrench is disclosed in U.S. Pat. No. 1,860,914, to Henry J. Wellman, which device includes a dual handle ratchet mechanism which uses a common, splined ratchet drum having interior bevel gears which mesh to provide a gear box for driving a socket drive when the handles are rotated with respect to each other.

It is an object of this invention to provide a new and improved, dual handle ratchet wrench which is characterized by a split housing, an interior ratchet drum provided with internal bevel gears and exterior splines, a pair of ratchet mechanisms on the handles for selectively engaging the splines on the ratchet drum, and a handle lock for securing the handles together and operating the wrench in conventional fashion in one embodiment, and allowing the handles to be separately manipulated, in another, more efficient embodiment of the invention.

Another object of this invention is to provide a new and improved ratchet wrench which is provided with a split housing, a top arm carried by the top housing segment of the split housing and a bottom arm cooperating with the bottom housing segment of the split housing, the arms also provided with separate ratchet mechanisms for selectively engaging a splined ratchet drum rotatably positioned inside the split housing and carrying a pair of oppositely-disposed side bevel gears rotatably mounted on a horizontal shaft secured to the ratchet drum, the top housing segment further carrying a top bevel gear which meshes with the side bevel gears, and a drive bevel gear rotatably cooperating with the bottom housing segment and also meshing with the side bevel gears and having a socket drive extending from the bottom housing, the side bevel gears and ratchet drum cooperating with the handles to effect a clockwise or counter-clockwise rotation of the socket drive when the ratchet mechanisms are in a selected first or second position, and the handles are manipulated away from each other and toward each other in sequence.

Still another object of the invention is to provide a ratchet wrench having a pair of housing segments joined by a split ring, and dual handles cooperating with the respective housing segments, and a ratchet means in each handle, the ratchet wrench further provided with a ratchet drum having four cooperating bevel gears in the interior thereof, the bottom one of the bevel gears carrying a socket drive extending outside the lower housing, and a handle lock means for selectively securing the handles together and operating the ratchet wrench in conventional fashion in one embodiment, and manipulating the handles both toward and away from each other for each selected position of the ratchet means on each handle, to drive the socket drive in either direction, in another, more efficient embodiment of the invention.

SUMMARY OF THE INVENTION

These and other objects of the invention are provided in a ratchet wrench having a split housing, the housing elements of which are interconnected in rotatable relationship by a snap ring, the top and bottom segments of the housing each incorporating a handle to effect rotation of the housing segments. A hollow, splined ratchet drum is situated inside the housing elements and ratchet means are provided on the top of the upper handle and the bottom of the lower handle to selectively engage the splines on the ratchet drum. A pair of side bevel gears are rotatably mounted on a horizontal drum shaft secured in the interior of the ratchet drum, and a top bevel gear is fixedly mounted to the inside surface of the top housing segment, and extends inside the ratchet drum to engage the shaft-mounted side bevel gears. A fourth bevel gear is rotatably provided inside the bottom housing segment and also engages the side bevel gears, the fourth bevel gear also carrying a socket drive extending through the bottom housing for attachment to a socket. A handle lock is provided in cooperation with the upper and lower handle to selectively secure the handles together in one embodiment of the invention and to permit the handles to be manipulated alternately toward and away from each other to rotate the socket drive in the clockwise and counter-clockwise direction in another embodiment, depending upon the position of the ratchet means on the handles.

BRIEF DESCRIPTION OF THE DRAWING

The invention will be better understood by reference to the accompanying drawings, wherein:

FIG. 5 is a bottom elevation of the ratchet wrench with the handles further spread in non-alignment;

FIG. 6 is a sectional view of the ratchet housing and internal working parts, taken along lines 6—6 in FIG. 2;

FIG. 7 is a sectional view of the ratchet housing, handles and internal working parts, taken along lines 7—7 in FIG. 2; and FIG. 8 is a top elevation, partially in section, of the ratchet wrench bottom housing and internal working parts, with the top housing removed.

DESCRIPTION OF THE PREFERRED EMBODIMENTS

Figure 1:
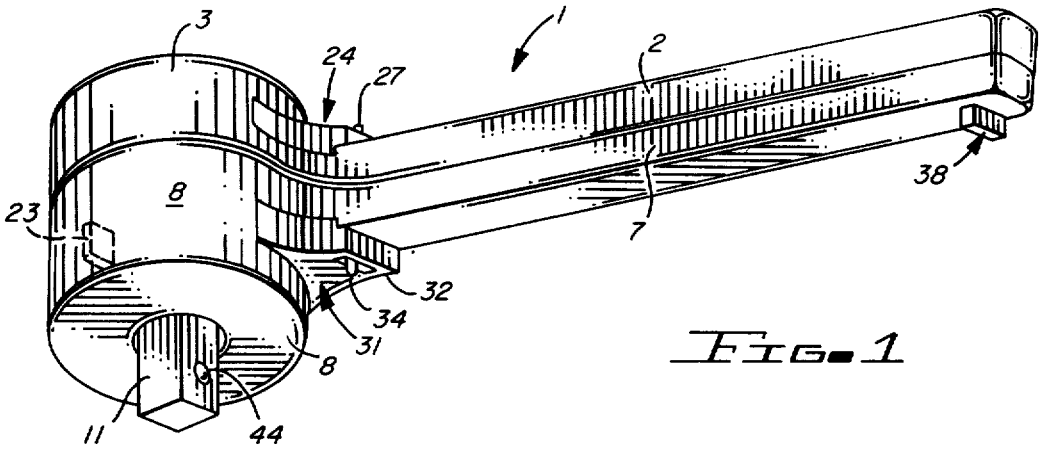
FIG. 1 is a perspective view of the ratchet wrench of this invention, with the handles locked together.
Figure 2:
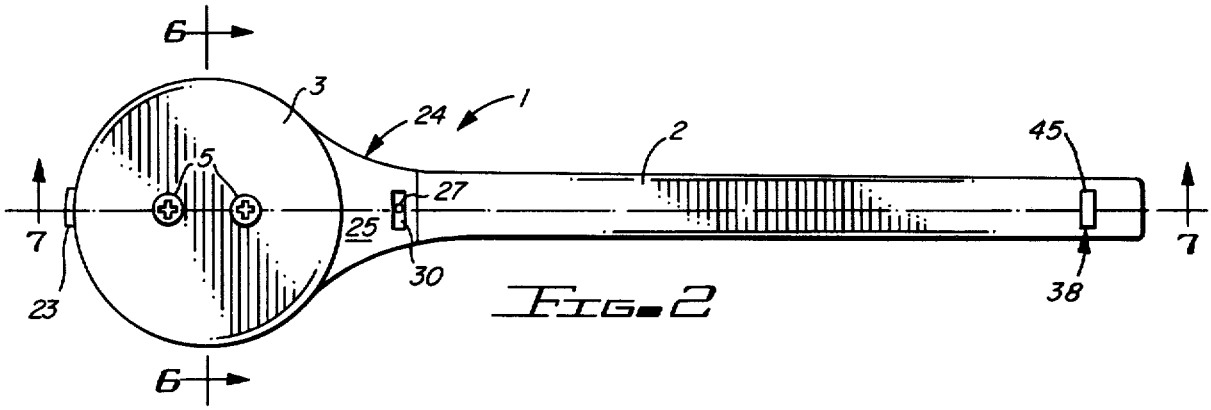
FIG. 2 is a top elevation of the ratchet wrench illustrated in FIG. 1.
Figure 3:
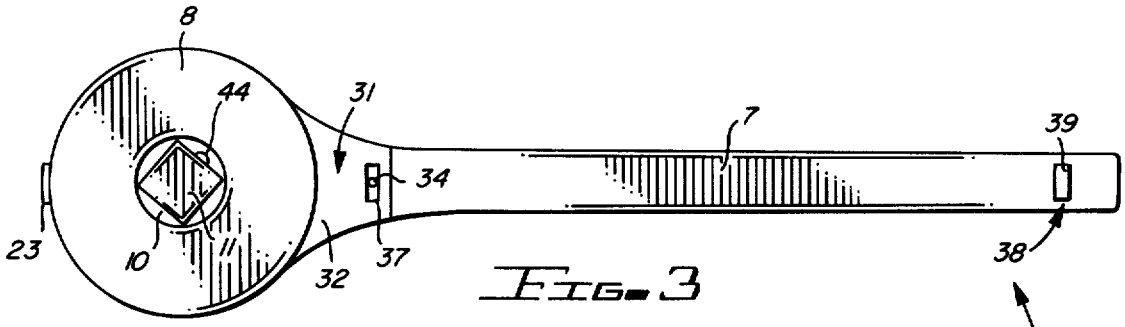
FIG. 3 is a bottom elevation of the ratchet wrench illustrated in FIG. 1.

Referring initially to FIGS. 1-3 of the drawings, in a preferred embodiment, the ratchet wrench of this invention is generally illustrated by reference numeral 1, and includes a top handle 2 cooperating with a top housing 3, and a bottom handle 7 cooperating with bottom housing 8. In a most preferred embodiment of the invention top handle 2 is integrally formed with top housing 3, and bottom handle 7 is similarly shaped or cast with bottom housing 8. A handle lock 38 is illustrated in locked configuration in FIG. 1 to secure top handle 2 and bottom handle 7 together in the position illustrated. A top ratchet 24 is fitted to top handle 2 where top handle 2 joins top housing 3, and a bottom ratchet 31 is similarly provided on bottom handle 7 and bottom housing 8. As illustrated in FIGS. 1 and 3, a socket drive 11, having a socket bias 44, projects from bottom housing 8 through a drive aperture 10, for attachment of conventional sockets to facilitate use of the ratchet wrench 1.

Figure 4:
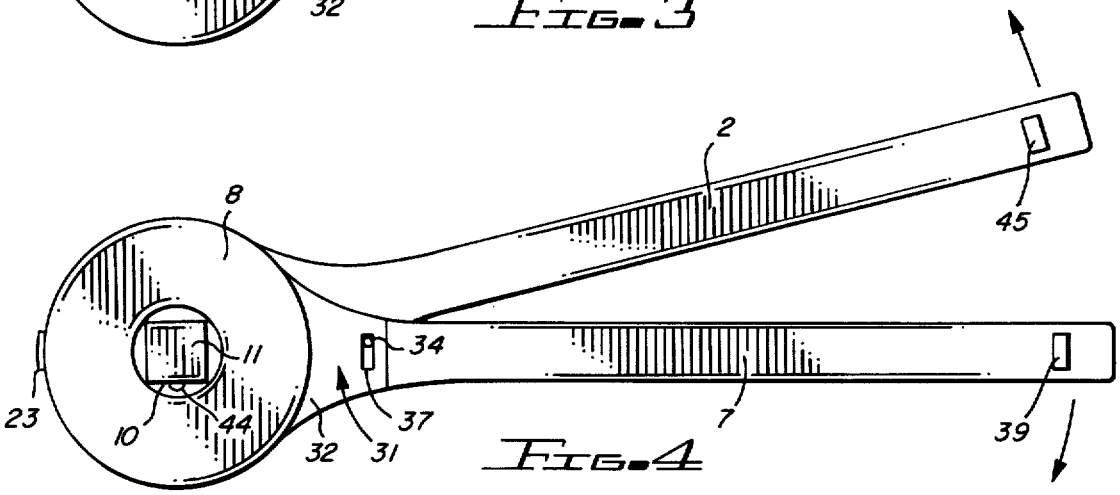
FIG. 4 is a bottom elevation of the ratchet wrench with the handles unlocked and rotated into a position of non-alignment.

Referring now to FIGS. 4 and 5 of the drawings, when handle lock 38 is manipulated as hereinafter described, top handle 2 and bottom handle 7 are rendered rotatable in either a counter-clockwise or a clockwise direction with respect to each other, depending upon the relative positions of the top ratchet 24 and the bottom ratchet 31, as hereinafter set forth. As illustrated in FIG. 4, rotation of top handle 2 and bottom handle 7 away from each other in the direction of the arrows effects a rotation of socket drive 11 in the counter-clockwise direction, for a selected position of top ratchet 24 and bottom ratchet 31. Similarly, as illustrated in FIG. 5, movement of top handle 2 and bottom handle 7 toward each other in the direction of the arrows causes a clockwise rotation of socket drive 11 for an alternative position of top ratchet 24 and bottom ratchet 31.

Referring now to FIGS. 6-8 of the drawings, in a most preferred embodiment of the invention top housing 3 and bottom housing 8 are rotatably joined by a snap ring 14, situated in a snap ring groove 15, formed in bottom housing flange 9 and top housing flange 4, which match, as illustrated in FIGS. 6 and 7. In a preferred embodiment of the invention the ends of the snap ring 14 are covered by a snap ring cap 23, which can be removed to effect disengagement of the snap ring 14 from the bottom housing flange 9 and the top housing flange 4. A generally cylindrically-shaped hollow ratchet drum 17 is disposed inside top housing 3 and bottom housing 8, and is provided with a plurality of radial splines 18 on the exterior surface thereof. Ratchet drum 17 is open at the top and bottom and carries a horizontally disposed drum shaft 22 across the diameter thereof, with an inner drum bevel gear 20 and an outer drum bevel gear 21 rotatably mounted on the drum shaft 22 in facing relationship adjacent the interior walls of the ratchet drum 17, as illustrated in FIGS. 7 and 8. A top bevel gear 6 is attached to the inside surface of top housing 3 by means of a pair of bolts 5, as illustrated in FIGS. 2 and 7, and a drive bevel gear 12, carrying a socket drive 11, is rotatably disposed inside ratchet drum 17 on the inside surface of bottom housing 8. In a most preferred embodiment of the invention the drive bevel gear 12 is provided with a bearing 13, which cooperates with the inside surface of bottom housing 8 to facilitate smooth rotation of drive bevel gear 12 and socket drive 11 with respect to bottom housing 8. As illustrated in FIGS. 6-8, top bevel gear 6 engages inner drum bevel gear 20 and outer drum bevel gear 21, while drive bevel gear 12, situated at the opposite end of ratchet drum 17, also engages inner drum bevel gear 20 and outer drum bevel gear 21, as illustrated. The top bevel gear 6, drive bevel gear 12, inner drum bevel gear 20 and outer drum bevel gear 21 are provided with well defined bevel gear teeth 16, as illustrated in FIGS. 6 and 8, in order to facilitate efficient meshing of the bevel gears. As illustrated in FIG. 7, a grease cavity 19 is provided inside ratchet drum 17, in order to lubricate top bevel gear 6, drive bevel gear 12, inner drum bevel gear 20 and outer drum bevel gear 21 during rotation of the bevel gears, as hereinafter described.

Referring now specifically to FIGS. 2–4 and 7, the top ratchet 24 and bottom ratchet 31 are illustrated in section, with top ratchet 24 having a top ratchet housing 25, and a top ratchet pawl 26 pivotally mounted on a top ratchet pivot pin 29, for selective engagement with the splines 18 on ratchet drum 17. Top ratchet spring 28 serves to maintain the top ratchet pawl 26 in the selected pivoted position, and a top ratchet pin 27 extends from the end of top ratchet pawl 26 through top ratchet housing slot 30 for engagement with the thumb or finger to adjust top ratchet pawl 26 to the desired position. Similarly, bottom ratchet 31 includes a bottom ratchet housing 32, having a bottom ratchet pawl 33 which is pivotally attached to bottom ratchet pivot pin 36, for engagement with the splines 18 in ratchet drum 17. Bottom ratchet pin 34 extends from bottom ratchet pawl 33 through bottom ratchet housing slot 37, to effect manipulation of the bottom ratchet pawl 33, as desired. As in the case of the top ratchet 24, a bottom ratchet spring 35 serves to maintain the bottom ratchet pawl 33 in the desired position, once the bottom ratchet pawl 33 is manipulated by the thumb or finger of the user. As further illustrated in FIG. 7 and as heretofore noted, top handle 2 and bottom handle 7 can be maintained in alignment by means of a handle lock 38, which includes a bottom element 39 and a top element 45. The bottom element 39 includes a bottom element shoulder 40, which is designed to register with a handle slot 41, extending through both the top handle 2 and the bottom handle 7. Seats 43 in bottom element 39 are provided for selective registration with a bottom element bias 42 to maintain bottom element 39 in a selected position in bottom handle 7. Similarly, top element 45 is provided with an extending top element shoulder 46, which also registers with handle slot 41, and a top element bias 47, provided in top handle 2, serves to register selectively with the seats 43 in top element 45 to maintain top element 45 in a selected position in top handle 2, or in top handle 2 and in bottom handle 7, as hereinafter described.

In operation, the ratchet wrench 1 of this invention is utilized as follows. Referring to FIGS. 4 and 6–8, when handle lock 38 is manipulated to the position illustrated in FIG. 7 where the junction between top element 45 and bottom element 39 is aligned with the plane dividing top handle 2 and bottom handle 7, top handle 2 and bottom handle 7 can be separately manipulated, as illustrated in FIG. 4. Furthermore, when bottom ratchet pin 34 is manipulated in bottom ratchet housing slot 37 to the position illustrated, and when top ratchet pin 27 is manipulated to a corresponding position in top ratchet housing 25, then as further illustrated in FIG. 7, top ratchet pawl 26 and bottom ratchet pawl 33 engage one of splines 18 in ratchet drum 17 to facilitate counter-clockwise rotation of ratchet drum 17 when top handle 2 and bottom handle 7 are sequentially rotated both toward and away from each other in the clockwise and counter-clockwise direction. Similarly, referring to FIG. 5 of the drawings, movement of the bottom ratchet pin 34 to the opposite side of bottom ratchet housing slot 37, and adjustment of the top ratchet pin 27 to a corresponding position in top ratchet housing slot 30, causes a clockwise rotation of socket drive 11 when top handle 2 and bottom handle 7 are manipulated both toward and away from each other. As illustrated in FIGS. 4 and 5, it will be appreciated that a particularly efficient mechanical advantage is apparent in certain movements of top handle 2 and bottom handle 7 in the operation of the ratchet wrench 1. This advantage is due to the rotation of the inner drum bevel gear 20, outer drum bevel gear 21, and the drive bevel gear 12, as driven by top bevel gear 6, and a corresponding rotation of the ratchet drum 17 by top ratchet 21 and bottom ratchet 31, which also effects rotation of inner drum bevel gear 20, outer drum bevel gear 21 and drive bevel gear 20. For example, referring again to FIGS. 4 and 7, when top handle 2 and bottom handle 7 are initially moved toward each other in the opposite direction from the direction indicated by the arrows, the top ratchet pawl 26 of top ratchet 24 is engaged with one of the splines 18 to drive ratchet drum 17, and this rotation of drive ratchet drum 17 causes rotation of the inner drum bevel gear 20 and outer drum bevel gear 21, and a corresponding rotation of drive bevel gear 12 and socket drive 11. Furthermore, while the ratchet wrench 1 is in this drive sequence, the socket drive 11 is rotating at the same speed as the top handle 2. This condition exists since bottom handle 7 is freely rotating on the ratchet drum 17 due to the release position of bottom ratchet pawl 33 in bottom ratchet 31, and the inner drum bevel gear 20 and outer drum bevel gear 21 are not driven by top bevel gear 6 to rotate on drum shaft 22, but instead, are caused to turn by rotation of the ratchet drum 17 only. However, when top handle 2 and bottom handle 7 are rotated away from each other in the direction of the arrows, with the top ratchet pawl 26 and bottom ratchet pawl 33 in the positions illustrated in FIGS. 4 and 7, the bottom ratchet pawl 22 then engages one of the splines 18 in drive configuration and causes counter-clockwise rotation of ratchet drum 17. Simultaneously, rotation of the top handle 2 in the clockwise direction effects rotation of the top bevel gear 6 in this direction at the same rotational speed as top handle 2, to cause inner drum bevel gear 20 and outer drum bevel gear 21 to rotate on drum shaft 22, and increase the speed of rotation of drive bevel gear 12 and socket drive 11.

Referring again to FIG. 5, the drive mode of ratchet wrench 1 with top ratchet pawl 26 and bottom ratchet pawl 33 in opposite positions from that illustrated in FIGS. 4 and 7, is opposite in function. For example, when top handle 2 and bottom handle 7 are forced toward each other in the direction of the arrows, the rotation of top bevel gear 6 drives the inner drum bevel gear 20 and the outer drum bevel gear 21, and the drive bevel gear 12 and socket drive 11 are caused to rotate faster than the rotational speed of the top handle 2. This mechanical advantage is realized in the same manner as the drive mode described above, since bottom handle 7 aids in the driving of socket drive 11 by directly driving ratchet drum 17 due to the engaged position of bottom ratchet pawl 33. When the top handle 2 and bottom handle 7 are moved away from each other, top handle 2 drives ratchet drum 17 and effects rotation of inner drum bevel gear 20 and outer drum bevel gear 21 to cause rotation of drive bevel gear 12 and socket drive 11 at a speed equal to the speed of rotation of top handle 2. In this drive mode bottom handle 7 is freely rotating with respect to ratchet drum 17 because of the release position of bottom ratchet pawl 33, and there is no rotation of top bevel gear 6 to speed up the rotation of socket drive 11.

It will be appreciated by those skilled in the art that in addition to the mechanical advantage achieved in ratchet wrench 1 due to the combination of a direct drive effect with a gearing boost, another advantage is realized, in that for each common position of the top ratchet pawl 26 in top ratchet 24 and bottom ratchet pawl 33 in bottom ratchet 31, movement of top handle 2 and bottom handle 7 in either rotational direction effects a rotation of socket drive 11 in one direction only. Accordingly, nuts which are loosely threaded on bolts in cramped places can be engaged by a socket of appropriate size inserted on socket drive 11, and either loosened or tightened, as desired, much faster than is possible with a conventional ratchet wrench, without the necessity of manipulating the nut by hand. Furthermore, considerable torque can be applied to top handle 2 and bottom handle 7 to loosen or tighten a nut without stressing the workstock carrying the subject bolt and nut, since two handles are used to apply the requisite pressure, instead of one.

Other advantages of the ratchet wrench of this invention will be apparent to those skilled in the art, and while the preferred embodiments of the invention have been described above, it will be recognized and understood that various modifications may be made therein, and the appended claims are intended to cover all such modifications which may fall within the spirit and scope of the invention.

Having described my invention with the particularity set forth above, what is claimed is:

1. A ratchet wrench comprising:

(a) a top housing and a top handle carried by said top housing in fixed relationship;

(b) a bottom housing adjacent said top housing and a bottom handle carried by said bottom housing in fixed relationship;

(c) a ratchet drum having a hollow interior and located inside said top housing and said bottom housing, and splines provided on the external surface of said ratchet drum;

(d) a shaft horizontally secured inside said ratchet drum and a pair of drum bevel gears rotatably mounted on said shaft in oppositely-disposed relationship;

(e) a top bevel gear secured to the inside of said top housing and engaging said drum bevel gears;

(f) a drive bevel gear in rotatable cooperation with said bottom housing and engaging said drum bevel gears, and a socket drive carried by said drive bevel gear and extending through said bottom housing, whereby rotation of said top housing effects rotation of said drum bevel gears and said drive bevel gear to rotate said socket drive;

(g) first ratchet means carried by said top housing and said top handle, and second ratchet means carried by said bottom housing and said bottom handle, said first ratchet means and said second ratchet means selectively cooperating with said splines in said ratchet drum to facilitate rotation of said ratchet drum in a selected direction and rotation of said drum bevel gears to drive said drive bevel gear upon rotatable manipulation of said top handle and said bottom handle; and (h) lock means cooperating with said top handle and said bottom handle to selectively lock said top handle and said bottom handle together and release said top handle and said bottom handle for rotational manipulation of said top handle and said bottom handle both toward and away from each other.

2. The ratchet wrench of claim 1 wherein said first ratchet means is mounted on the top of said top handle and said second ratchet means is mounted on the bottom of said bottom handle.

3. The ratchet wrench of claim 1 wherein said top housing is integrally formed with said top handle and said bottom housing is integrally formed with said bottom handle.

4. The ratchet wrench of claim 1 wherein:

(a) said first ratchet means is mounted on the top of said top handle and said second ratchet means is mounted on the bottom of said bottom handle; and (b) said top housing is integrally formed with said top handle and said bottom housing is integrally formed with said bottom handle.

5. The ratchet wrench of claim 1 further comprising ring means cooperating with said top housing and said bottom housing to rotatably secure said top housing to said bottom housing.

6. The ratchet wrench of claim 1 further comprising ring means cooperating with said top housing and said bottom housing to rotatably secure said top housing to said bottom housing, and wherein:

(a) said first ratchet means is mounted on the top of said top handle and said second ratchet means is mounted on the bottom of said bottom handle; and (b) said top housing is integrally formed with said top handle and said bottom housing is integrally formed with said bottom handle.

7. The ratchet wrench of claim 1 wherein said lock means further comprises a bottom lock element slidably disposed in said bottom handle and a top lock element slidably disposed in said top handle adjacent said bottom lock element, and retaining means in said bottom handle and said top handle to prevent said bottom lock element and said top lock element from exiting said bottom handle and said top handle, respectively, whereby said top handle and said bottom handle are locked together when said top lock element and said bottom lock element are displaced in said bottom handle and said top handle to the point where said top lock element is present in both said top handle and said bottom handle.

8. The ratchet wrench of claim 1 further comprising bearing means cooperating with said drive bevel gear and said bottom housing to facilitate ease of rotation of said drive bevel gear with respect to said bottom housing.

9. The ratchet wrench of claim 1 further comprising ring means cooperating with said top housing and said bottom housing to rotatably secure said top housing to said bottom housing and bearing means cooperating with said drive bevel gear and said bottom housing to facilitate ease of rotation of said drive bevel gear with respect to said bottom housing, and wherein:

(a) said first ratchet means is mounted on the top of said top handle and said second ratchet means is mounted on the bottom of said bottom handle;

(b) said top housing is integrally formed with said top handle and said bottom housing is integrally formed with said bottom handle; and (c) said lock means further comprises a bottom lock element slidably disposed in said bottom handle and a top lock element slidably disposed in said top handle adjacent said bottom lock element, and retaining means in said bottom handle and said top handle to prevent said bottom lock element and said top lock element from exiting said bottom handle and said top handle, respectively, whereby said top handle and said bottom handle are locked together when said top lock element and said bottom lock element are displaced in said bottom handle and said top handle to the point where said top lock element is present in both said top handle and said bottom handle.

10. The ratchet wrench of claim 9 further comprising bias means in said top handle and said bottom handle to secure said top lock element and said bottom lock element in a selected position in said top handle and said bottom handle, respectively.

* * * * *